US007125369B2

(12) United States Patent
Endelman

(10) Patent No.: US 7,125,369 B2
(45) **Date of Patent: *Oct. 24, 2006**

(54) REFORMER EXERCISE APPARATUS HAVING A TRAPEZE BAR

(75) Inventor: Ken Endelman, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 247 days.

This patent is subject to a terminal disclaimer.

(21) Appl. No.: 10/804,256

(22) Filed: Mar. 18, 2004

(65) Prior Publication Data

US 2004/0176227 A1 Sep. 9, 2004

Related U.S. Application Data

(63) Continuation-in-part of application No. 10/723,407, filed on Nov. 25, 2003, and a continuation-in-part of application No. 10/438,579, filed on May 14, 2003, now Pat. No. 6,971,976, which is a continuation of application No. 10/035,842, filed on Dec. 24, 2001, now Pat. No. 6,926,650, which is a continuation of application No. 09/835,204, filed on Apr. 12, 2001, now Pat. No. 6,527,685, which is a continuation of application No. 09/521,555, filed on Mar. 9, 2000, now Pat. No. 6,371,895, which is a continuation of application No. 09/275,755, filed on Mar. 25, 1999, now Pat. No. 6,186,929, which is a continuation of application No. 09/266,286, filed on Mar. 11, 1999, now abandoned.

(51) Int. Cl.
*A63B 26/00* (2006.01)

(52) U.S. Cl. ..... 482/142; 482/121

(58) Field of Classification Search ..... 482/142, 482/121, 70–72, 96, 57, 135, 110, 52–54, 482/95

See application file for complete search history.

(56) References Cited

U.S. PATENT DOCUMENTS

| | | | |
|---|---|---|---|
| 339,638 | A | 4/1886 | Goldie |
| 1,621,477 | A | 3/1927 | Pilates |
| 1,738,987 | A | 12/1929 | Dattilo |
| 1,750,549 | A | 3/1930 | Thomson et al. |
| 1,979,783 | A | 11/1934 | Williams et al. |

(Continued)

FOREIGN PATENT DOCUMENTS

| | | |
|---|---|---|
| FR | 1470421 | 1/1967 |

OTHER PUBLICATIONS

Stott Equipment Advertisements, Canada.*

(Continued)

*Primary Examiner*—Lori Amerson
(74) *Attorney, Agent, or Firm*—Greenberg Traurig LLP

(57) ABSTRACT

A reformer exercise apparatus comprises a rectangular frame, a movable carriage mounted on the frame for supporting a user an elongated elastic member extending between the frame and the movable carriage for biasing the carriage toward the one end of the frame, and a U shaped trapeze bar assembly removably fastened to the reformer frame via outwardly open T shaped slots in each reformer frame rail. The trapeze assembly includes a support bracket assembly slidably disposed in the slot to fasten a trapeze leg to the reformer frame. the support bracket assembly permits the trapeze assembly to be folded parallel to the reformer frame for storage and transport, and rigidly fastened to the reformer frame in an upright position during use.

20 Claims, 7 Drawing Sheets

U.S. PATENT DOCUMENTS

| | | | | |
|---|---|---|---|---|
| 1,980,036 | A | 11/1934 | Casler et al. | |
| 2,733,922 | A | 2/1956 | Diego | |
| 3,261,606 | A | 7/1966 | Elia et al. | |
| 3,586,322 | A | 6/1971 | Kverneland | |
| 3,770,267 | A | 11/1973 | McCarthy | |
| 3,892,404 | A | 7/1975 | Martucci | |
| 4,084,815 | A | 4/1978 | Flannery | |
| 4,272,074 | A | 6/1981 | Sferele | |
| 4,290,600 | A | 9/1981 | Kolbel | 272/137 |
| 4,357,010 | A | 11/1982 | Telle | 272/117 |
| 4,376,533 | A | 3/1983 | Kolbel | 272/137 |
| 4,383,684 | A | 5/1983 | Schliep | |
| 4,517,966 | A | 5/1985 | von Othegraven | 128/75 |
| 4,700,945 | A | 10/1987 | Rader | |
| 4,706,953 | A | 11/1987 | Graham | |
| 4,709,918 | A | 12/1987 | Grinblat | 272/97 |
| 4,768,776 | A | 9/1988 | Giannotti | |
| 4,775,150 | A | 10/1988 | Graham | 272/143 |
| 4,776,583 | A | 10/1988 | Jennings | 272/73 |
| 4,884,802 | A | 12/1989 | Graham | |
| 4,911,438 | A | 3/1990 | Van Straaten | |
| 4,974,832 | A | 12/1990 | Dalebout | |
| 5,014,966 | A | 5/1991 | Wang | 267/64 |
| 5,024,214 | A | 6/1991 | Hayes | |
| 5,066,005 | A | 11/1991 | Luecke | |
| 5,207,628 | A | 5/1993 | Graham | 482/140 |
| 5,263,913 | A | 11/1993 | Boren | |
| 5,338,278 | A | 8/1994 | Endelman | |
| 5,352,169 | A | 10/1994 | Eschenbach | 482/57 |
| 5,364,327 | A | 11/1994 | Graham | |
| D354,780 | S | 1/1995 | Endelman | |
| D354,781 | S | 1/1995 | Endelman | |
| 5,423,729 | A | 6/1995 | Eschenbach | 482/70 |
| D362,700 | S | 9/1995 | Breibart et al. | |
| 5,529,554 | A | 6/1996 | Eschenbach | 482/57 |
| 5,580,340 | A | 12/1996 | Yu | 482/96 |
| 5,607,381 | A | 3/1997 | Endelman | |
| 5,653,670 | A | 8/1997 | Endelman | |
| 5,681,249 | A | 10/1997 | Endelman | |
| 5,776,037 | A * | 7/1998 | Millington | 482/91 |
| 5,792,033 | A | 8/1998 | Merrithew | 482/96 |
| 5,795,271 | A | 8/1998 | Pearson | 482/72 |
| 5,807,217 | A | 9/1998 | Endelman | |
| 5,816,981 | A | 10/1998 | Hung | 482/54 |
| 5,853,357 | A | 12/1998 | Jones, Jr. | 482/140 |
| 6,179,759 | B1 | 1/2001 | Tellone | 482/111 |
| 6,186,929 | B1 | 2/2001 | Endelman et al. | 482/121 |
| 6,206,530 | B1 | 3/2001 | Eberts | 359/879 |

OTHER PUBLICATIONS

Stott—Rehab Reformer Assembly Manual, Canada.*
Stott Equipment Advertisements (Canada).
Stott—Rehab Reformer Assembly Manual (Canada).

* cited by examiner

REFORMER EXERCISE APPARATUS HAVING A TRAPEZE BAR

CROSS REFERENCE TO RELATED APPLICATIONS

This application is a continuation-in-part of U.S. patent application Ser. No. 10/723,407, filed Nov. 25, 2003. This application is also a continuation-in-part of U.S. patent application Ser. No. 10/438,579, filed on May 14, 2003 now U.S. Pat. No. 6,971,976, which is a continuation of U.S. patent application Ser. No. 10/035,842, filed on Dec. 24, 2001 now U.S. Pat. No. 6,926,650, which is a continuation-in-part of U.S. patent application Ser. No. 09/835,204, filed on Apr. 12, 2001, now U.S. Pat. No. 6,527,685, which is a continuation-in-part of U.S. patent application Ser. No. 09/521,555, filed on Mar. 9, 2000, now U.S. Pat. No. 6,371,895, which is a continuation-in-part of U.S. patent application Ser. No. 09/275,755, filed Mar. 25, 1999, now U.S. Pat. No. 6,186,929 which is also a continuation-in-part of U.S. patent application Ser. No. 09/266,286, filed Mar. 11, 1999, now abandoned, all of which are hereby incorporated by reference in their entirety.

BACKGROUND OF THE INVENTION

1. Field of the Invention

This invention relates generally to the field of exercise equipment in which a movable carriage is utilized to at least partially support a user's body, commonly referred to as a "reformer", and more particularly to a reformer that incorporates a trapeze frame.

2. Description of the Related Art

Joseph H. Pilates, in U.S. Pat. No. 1,621,477, originally developed the concept of using a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's trunk, legs and/or arms. Since that time Joseph Pilates developed many changes and improvements in the design of such an apparatus, and more recently, have been evolved by his students and others. U.S. Pat. No. 5,066,005 and my patents referred to above are representative of the current state of evolutionary development of these changes that have taken place since 1927.

The current reformer type exercise apparatus includes a wheeled platform carriage, which rides on a generally rectangular wooden or metal frame. The above referenced patent discloses examples of wood framed reformers. An example of a metal frame reformer is disclosed in U.S. Pat. No. 5,792,033 to Merrithew. The carriage, which rides on the frame, is connected to a series of parallel springs or elastic members, which are in turn connected to a foot end of the rectangular frame. The carriage rides on parallel rails or tracks typically mounted to the inside of or incorporated into the longer sides of the rectangular frame. This carriage has a flat, padded upper surface and typically includes a pair of spaced, padded, upright shoulder stops and a headrest at one end to support the shoulders and head of the user when he/she is reclined on the carriage. An adjustable foot bar, foot support, or footrest against which the user places his/her feet is mounted to the foot end of the rectangular frame. The user can then push against the footrest to move the carriage along the track away from the footrest against spring tension to exercise the leg and foot muscle groups in accordance with prescribed movement routines. U.S. Pat. Nos. 5,338,276, 5,607,381 and 5,681,249 disclose reformers and several footrest arrangements and adjustable headrest assemblies for this type of exercise apparatus.

There are a number of exercises that are best performed on what is conventionally known as a "trap table". A trap table is of similar size as a reformer, having a rectangular frame and a cushioned rectangular upper surface, raised about three feet off a supporting floor for a user to either sit or lie on. A vertical support bar is fastened to each corner of the frame. Each bar extends about four feet above the frame and a horizontal rectangular tubular frame joins the upper ends of each of the support bars to form a rigid structure. Attachments to these bars, such as springs, padded handles and a trapeze swing bar permit a variety of exercises to be performed by a user that could not otherwise be performed on a reformer. The trap table is large, providing a platform about three feet above a supporting floor, with the tubular frame extending four to five feet above the user surface. One of the drawbacks, however, of the trap table is its size. Thus there is a need for a reformer type of exercise apparatus that can be efficiently stored which also has the capabilities for the user to perform exercises that could heretofore only have been practiced on a trap table.

SUMMARY OF THE INVENTION

The reformer exercise apparatus in accordance with the present invention addresses the above-identified drawbacks in reformer designs. The present invention is a reformer exercise apparatus that includes a collapsible trapeze frame at one end of the generally rectangular reformer frame. In a preferred embodiment, the collapsible trapeze frame is also removably fastened to the reformer frame. In another embodiment, the collapsible trapeze frame may alternatively be adjustably positioned at different operational locations along the length of the reformer frame.

The frame of a reformer in accordance with the present invention has a pair of spaced parallel side rail members spaced in parallel relation by a foot end support member and a head end support member and incorporates a pair of elongated extrusion members in the side rail members. These elongated extrusion members form an outwardly open T shaped slot running along the length of each parallel side of the frame. A trapeze assembly in accordance with the present invention is slidably mounted in the T shaped slots, and preferably located at the head end of the frame.

The reformer includes a wheeled carriage that is movably mounted on the parallel track members of the generally rectangular frame. The carriage has a pair of upwardly extending shoulder stops mounted thereto at one end and a headrest between the shoulder stops that extends outward from the carriage toward the head end of the frame. A plurality of elastic members may be selectively connected between the foot end of the frame and the carriage to elastically bias the carriage toward the foot end of the frame.

The trapeze assembly includes an upside down, generally U shaped arched frame having a spaced pair of parallel legs. Each leg is removably received in a T slot clamp bracket assembly that fastens the leg in the T slot. The U shaped trapeze frame may be pivoted in the bracket assemblies to a folded position so as to lie generally along the top of the reformer frame for compact storage, and rotated in the bracket assemblies to a substantially vertical operating position for use. The trapeze assembly includes at least one trapeze bar suspended by trapeze arms from the trapeze frame, and includes arm cord pulleys mounted in longitudinal slots in the trapeze frame legs, thus eliminating a need for separate arm cord pulley supports generally provided in the reformer exercise apparatus.

Other objects, features and advantages of the present invention will become apparent from a reading of the following detailed description when taken in conjunction with the accompanying drawing wherein a particular embodiment of the invention is disclosed as an illustrative example.

DETAILED DESCRIPTION OF THE INVENTION

Figure 1:
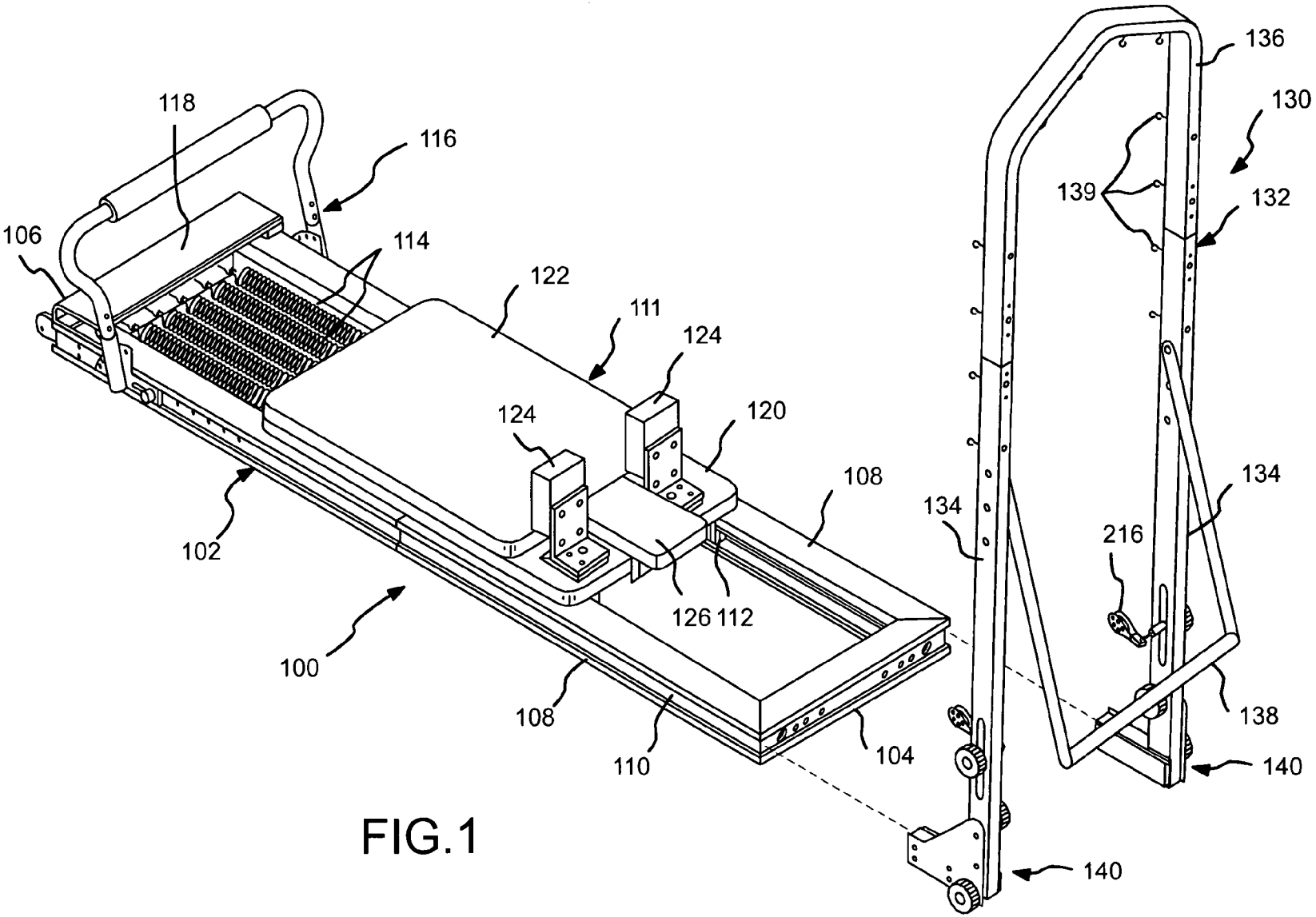
FIG. 1 is an upper perspective view of a first embodiment of the reformer exercise apparatus in accordance with the present invention with the carriage shown in a partially tensioned position away from the spring anchor assembly at the foot end of the frame and the trapeze assembly spaced from the frame rails, with the trapeze assembly shown in an operating position.
Figure 2:
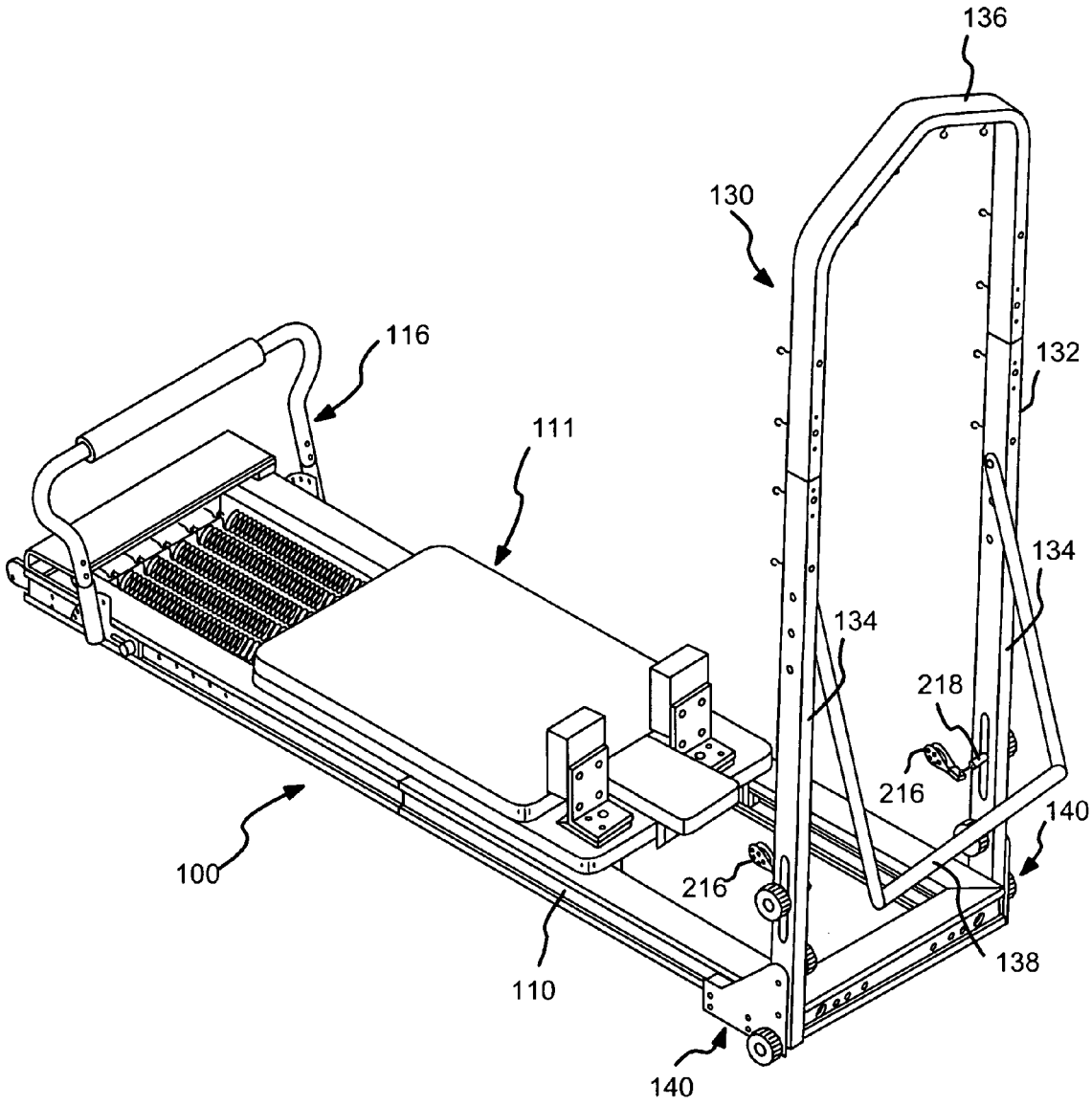
FIG. 2 is an upper perspective view of the reformer exercise apparatus shown in FIG. 1 with the trapeze assembly installed on the frame rails.

An exercise apparatus 100 in accordance with a first embodiment of the present invention is shown in upper and lower perspective views in FIGS. 1 and 2 respectively. The exercise apparatus 100 comprises a generally rectangular frame 102 having a head end 104 and a foot end 106 and a pair of parallel track or rail members 108 separating the head end 104 from the foot end 106. Each of the rail members 108 has an outwardly open T shaped slot 110 running the length of the rail member 108.

A movable carriage 111 rides on four roller/guide wheel assemblies 112, one of which can barely be seen in FIG. 1, fastened to the underside of the carriage 111. These wheel assemblies 112 roll on the track members 108 to support and guide movement of the carriage 111 back and forth along the track members 108 of the frame 102. A plurality of elastic members, e.g., springs 114 are selectively connected between the carriage 111 and the foot end 106 to bias the carriage 111 toward the foot end 106.

A foot bar assembly 116 is removably fastened to the frame 102 near the foot end 16 so as to provide a stationary support for a user to push against in order to move the carriage 111 back and forth along the track members 108. The foot end 106 also includes a flat foot platform 118 for a user to place one foot on while the other foot is placed on the carriage 111 for standing exercises on the apparatus 100.

The head end 104 is designed to space the rail members 108 rigidly apart. The head end 104 is preferably a rectangular box tubular extrusion member made preferably of aluminum permanently fastened to the head ends of the rail members 108. The carriage 111 comprises a flat support platform 120 which has a generally rectangular shape. A cushion pad 122 is secured to an upper surface of the platform 120. A pair of shoulder stops 124 are spaced apart near one end of and fastened to the rectangular platform 120. These shoulder stops 124 engage with a user's shoulders when the user lies on his or her back on the carriage 111 while exercising on the apparatus 100. A padded headrest 126 is fastened via a hinge at a base end to the platform 120 between the shoulder stops 124.

Figure 3:
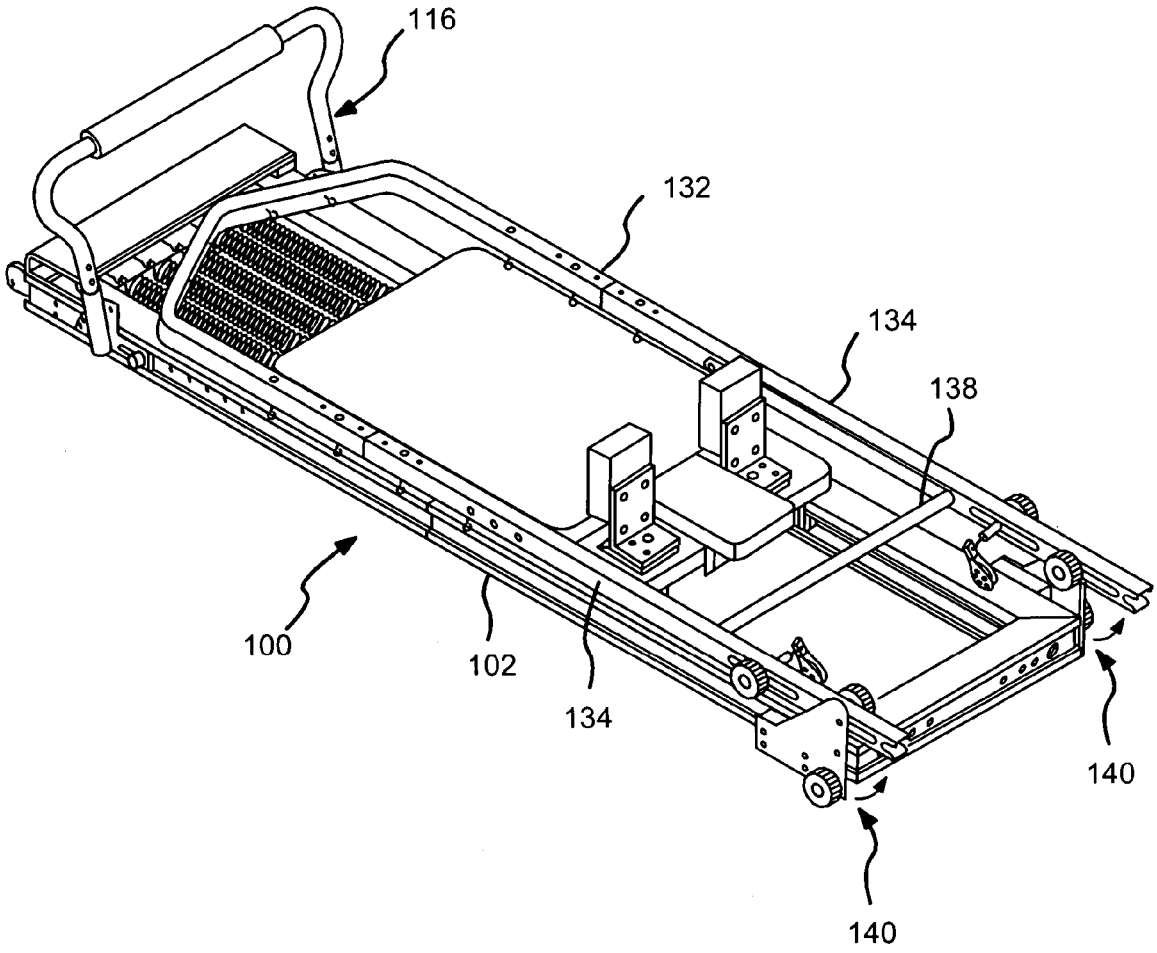
FIG. 3 is an upper perspective view of the reformer exercise apparatus as in FIG. 2 with the trapeze assembly in a storage position.

A trapeze assembly 130 in accordance with the present invention is slidably installed in the T shaped slots 110 in the rails 108. The trapeze assembly 130 includes an upside down U shaped or arched frame 132 that has two parallel legs 134 joined by a U shaped upper section 136, typically has a trapeze bar 138 suspended from the legs 134, and has a pair of support bracket assemblies 140 that slide into the T shaped slots 110 in the rails 108. These support bracket assemblies 140 permit the trapeze frame to be rigidly positioned in an upright operating position as shown in FIG. 2 and in a collapsed, storage position generally parallel to and on top of the frame 102 as shown in FIG. 3.

Figure 4:
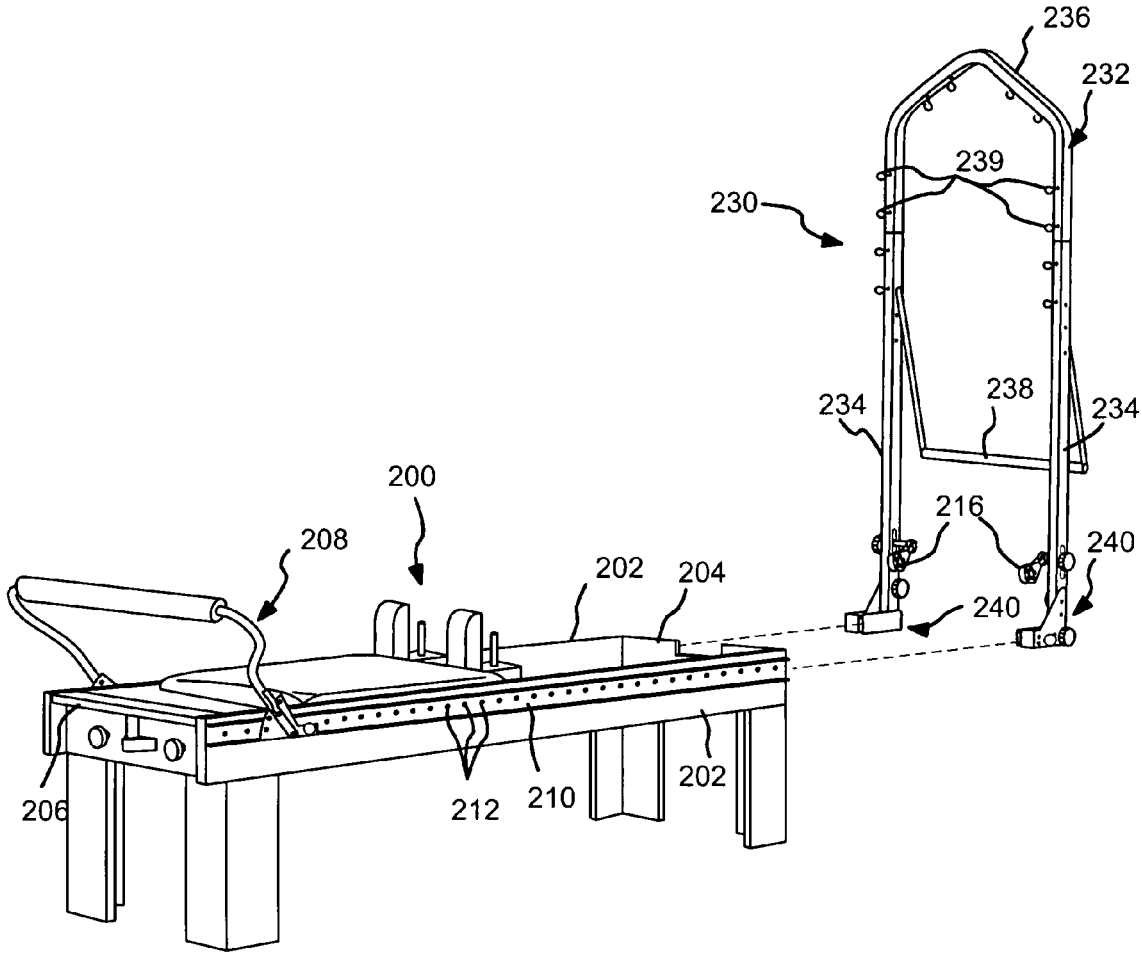
FIG. 4 is an alternative reformer apparatus in accordance with the invention with a trapeze assembly shown positioned for installation on the T slots in the frame rails.
Figure 5:
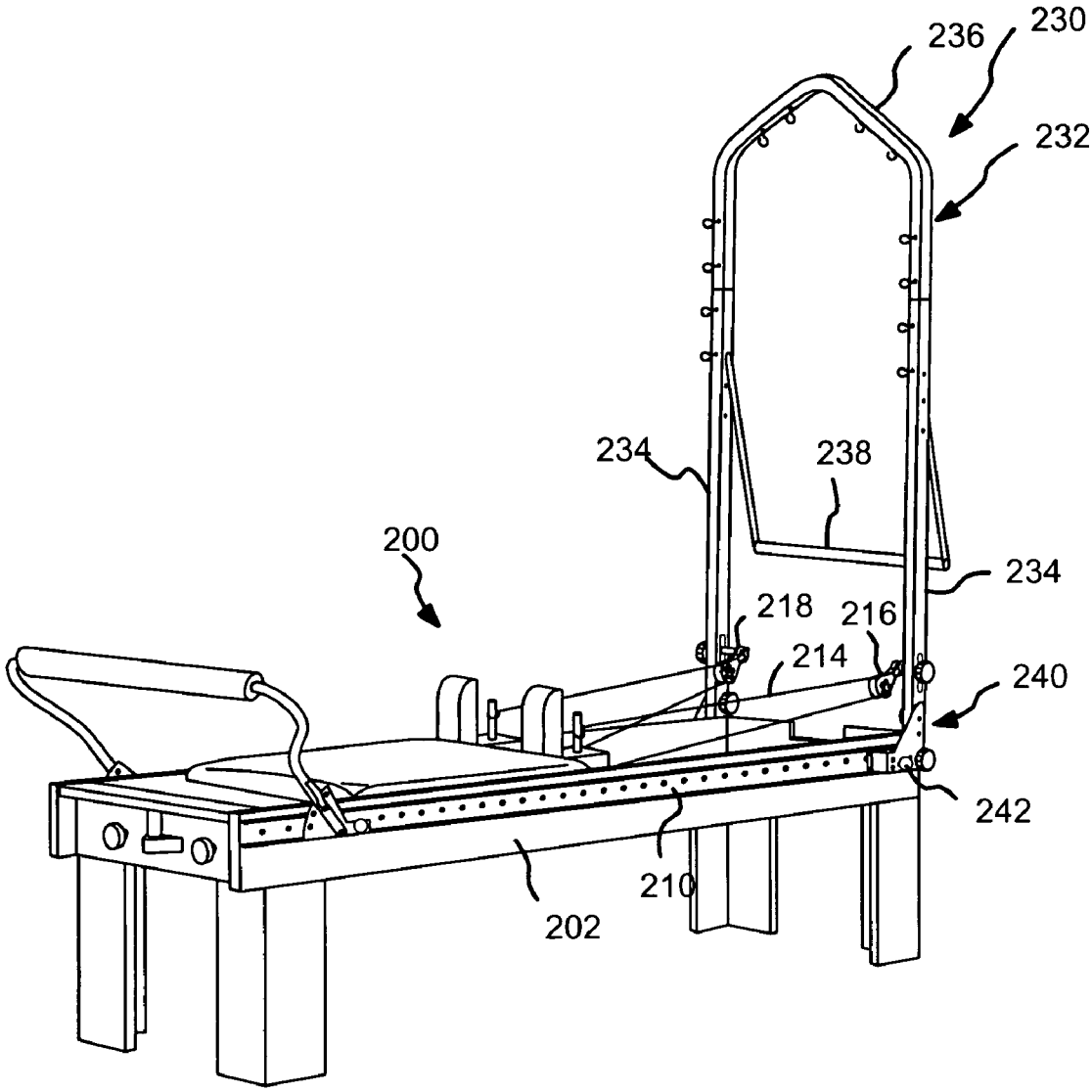
FIG. 5 is an assembled perspective view of the reformer apparatus shown in FIG. 4.

An alternative reformer with trapeze assembly in accordance with the present invention is shown in FIGS. 4 and 5. In this embodiment, the reformer 200 again has a pair of parallel side rails 202 separated by a head end 204 and a foot end 206. A foot bar assembly 208, similar to the foot bar assembly 116, is fastened to the foot end of each of the side rails 202 in T shaped slots 210 that run the full length of the side rails 202 of the reformer frame. A trapeze assembly 230 is slidably disposed in the T shaped slots 210 in a similar manner to that described above with reference to the first embodiment 130. However, in this embodiment, the trapeze assembly 230 may be selectively positioned virtually anywhere along the length of the reformer frame.

The T shaped slots 210 have spaced holes 212 that also run the full length of the side rails 202. These holes 212 permit the foot bar assembly 208 to be selectively locked in the holes 212 to position the foot bar assembly 212 at virtually any position along the reformer frame. Similarly, the support brackets of the trapeze assembly 230 can be positioned at virtually any position along the length of the slots 210, and indexed to positions corresponding to the holes 212. This feature permits a number of exercises to be performed that were heretofore not possible.

An assembled view of the reformer 200 with the trapeze assembly 230 installed at the head end 204 is shown in FIG. 5. In addition, a pair of arm cords 214 is shown installed on the pulleys 216 that depend from a pair of pulley anchor posts 218 as will be more fully described with reference to FIG. 7 below. Note that the anchor posts 218 may be adjustably raised or lowered in slots in the legs of the frame of the trapeze assembly 230.

The trapeze assembly 230 includes an upside down U shaped or arched frame 232 that has two parallel legs 234 joined by a U shaped upper section 236, typically has a trapeze bar 238 suspended from the legs 234 and has a pair of support bracket assemblies 240 that slide into the T shaped slots 210 in the rails 202. These support bracket assemblies 240 permit the trapeze frame 232, as in the first embodiment, to be rigidly positioned in an upright operating position as shown in FIGS. 4 and 5 and in a collapsed, storage position generally parallel to and on top of the frame rails 202 as shown in FIG. 3. The frame 232 also carries a series of spaced eyebolts 239 for anchoring ends of a variety of elastic members such as springs 114 to the frame 232. The other ends of the springs 114 may be fastened to the trapeze bar 238 or, for example, connected to a handgrip and stretched and retracted by a user.

In this embodiment shown in FIGS. 5 and 6, the support bracket assembly 240 is the same as that described below with reference to FIGS. 6 and 7, except that the assembly 240 also includes a spring loaded pin/knob 242 that extends through the assembly 240 into one of the holes 212 in the T shaped slots 210. This spring loaded pin 242 permits the indexing of the trapeze assembly 230 along the rails 202. The user simply withdraws each of the pins 242 to permit the assembly to be slid to a different position along the T shaped slots 210. When the pin 242 is released, the bracket 240 is locked in a predetermined position on the frame 202. The assembly 240 is then securely fastened into position as described below.

Figure 6:
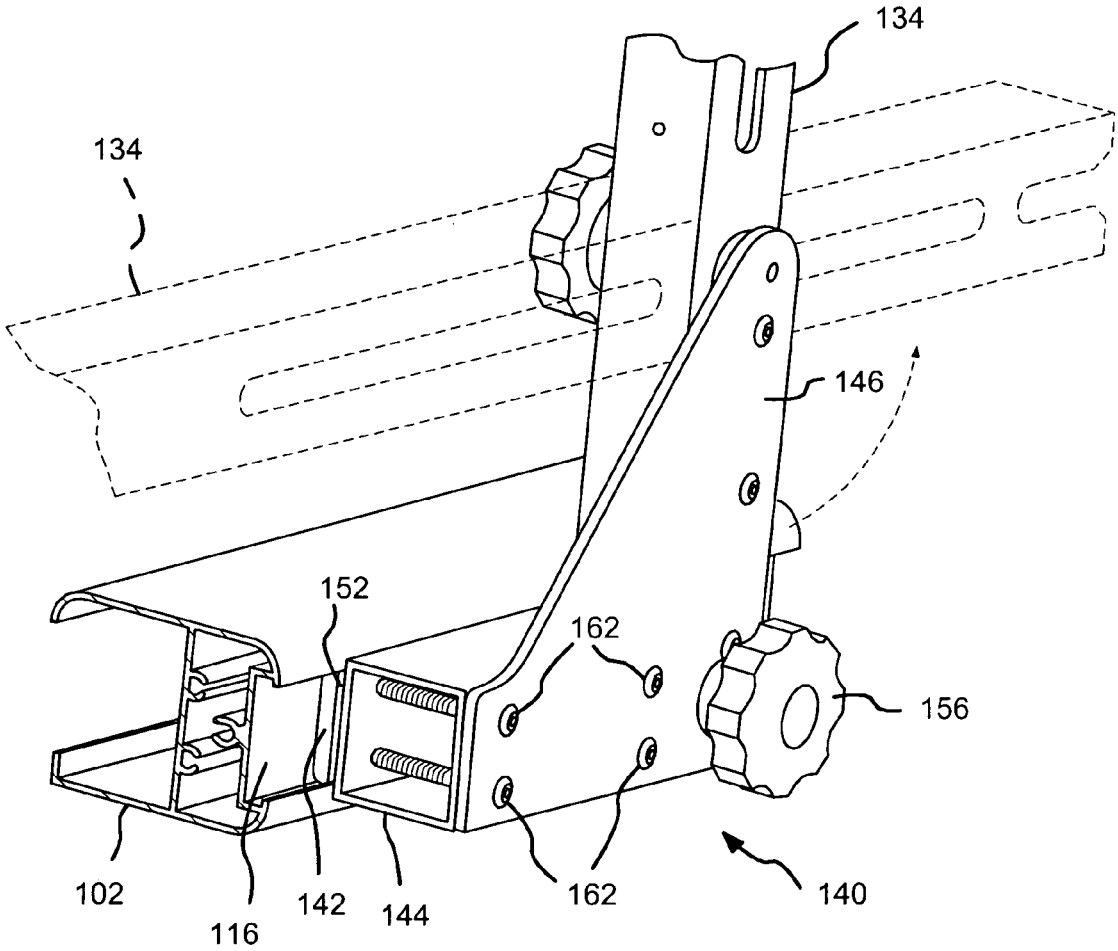
FIG. 6 is an enlarged partial view of trapeze assembly bracket assembly at the head end of the reformer shown in FIGS. 1 and 2 with the trapeze frame oriented upright, and in a storage position shown in dashed lines.
Figure 7:
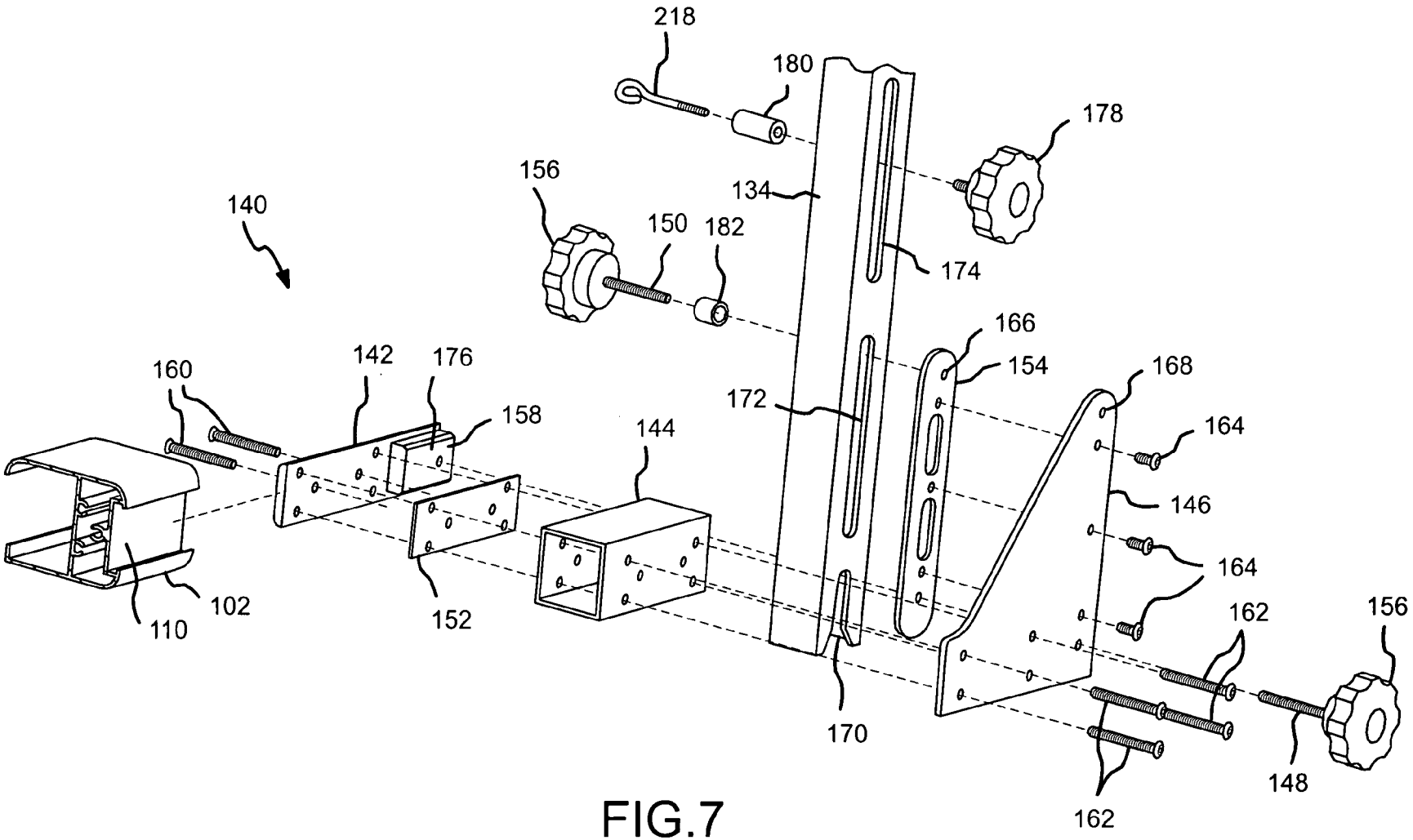
FIG. 7 is an exploded perspective view of the trapeze assembly bracket assembly shown in FIG. 6.

Turning now to FIGS. 6 and 7, a detailed description of the bracket assembly 140 is provided. It is to be understood that this description applies similarly to the support bracket assembly 240 shown in FIGS. 4 and 5 except for the addition of the spring loaded pin 242, which is not shown in FIGS. 6 and 7. An enlarged view of the bracket assembly 140 installed on frame 102 and supporting one leg 134 of the trapeze frame 132 is shown in FIG. 6. The leg 134 of the trapeze frame 132 is shown in a storage position in phantom lines as well. An exploded view of the bracket assembly 140 is provided in FIG. 7.

The bracket assembly 140 basically includes an elongated inner plate 142, a spacer tube 144, an outer bracket plate 146, and a pair of upper and lower clamping bolts 148 and 150. In the preferred embodiment shown, the assembly 140 also includes a spacer plate 152 and an elongated pivot washer plate 154. The spacer plate 152 is sized to center the inner plate 142 in the T shaped slot 110. Each of the clamping bolts 148 and 150 has a hand knob 156 permanently attached to one end of the bolt.

The inner plate 142 is an elongated, generally rectangular plate with a raised rectangular clamp portion 158 at one end thereof. The cross sectional shape of the inner plate 142 is complementary to the T shaped slot 110 in the frame 102 so that the inner plate 142 can be slipped into the T shaped slot 110 and slidably moved to various positions within the slot 110. The rectangular clamp portion 158 is sized so that its face projects slightly out of and parallel to the slot 110. The square spacer tube 144 and the spacer plate 152 are sized to fit onto the inner plate 142 adjacent the clamp portion 158. A pair of flat head bolts 160 extend through the inner plate 142, the spacer plate 152, and into the spacer tube 144. These bolts secure the inner plate, the spacer plate 152 and the spacer tube 144 together as a unit, with conventional nuts, not shown. The outer plate 146 is in turn fastened to the inner plate 142 through the spacer tube 144 and spacer plate 152 with four hex head bolts 162. When these bolts 162 are threaded into the inner plate 142 and tightened, the assembly of these four components becomes a rigid unit.

The height of the inner plate 142 is chosen so that its upper edge can be slipped under the upper edge of the slot 110 in the reformer 100 to permit the plate to be rotated so that the lower edge enters into the slot 110, when the assembly is loosely assembled with the flat head bolts 160. When the inner plate 142 is fully positioned in the slot 110, the assembly of the inner plate 142, the spacer plate 152, and spacer tube 144 can be tightened together via bolts 160. This action causes the spacer plate 152 to center the inner plate 142 in the slot 110 such that the assembly of plates and spacer tube cannot be removed from the slot 110. However, in the reformer 200 shown in FIGS. 4 and 5, the fully assembled and tightened assembly (140) 240 may be simply slid into the end of the T shaped slot 210.

In the embodiment 140 shown in FIG. 7, the elongated pivot washer plate 154 is fastened to the outer plate 146 with three screws 164. These screws form a rigid connection between the outer plate 146 and the washer plate 154. Washer plate 154 has an upper threaded hole 166 that aligns with bore 168 through the outer plate 146. This hole 166 receives the distal end of the bolt 150. The bore 168 acts as a clearance passage for the end of the bolt 150.

Each of the frame legs 134 is a square tube. The lower end of each of the trapeze frame legs 134 has a pair of open slots 170 in opposite sides of the square tube end. A first pair of closed slots 172 in the same opposite sides of the square tube frame legs 134 is spaced from the slots 170. A second pair of closed slots 174 is spaced axially from the first pair of closed slots 172. The upper clamp bolt 150 passes through a spacer 182 and through the lower closed slots 172, threads into the threaded hole 166 in the washer plate 154, and extends partially into the bore 168 when tightened to fasten the leg 134 to the upper end of the bracket plate 146. The lower bolt 148 passes through the outer plate 146, a through bore in the washer plate, through the open slots 170 and into a threaded bore 176 in the clamp portion 158 of the inner plate 142. When the bolt 148 is tightened, the lower end of the leg 134 is tightly clamped between the washer plate 154 and the clamp portion of the inner plate 142. At the same time, the inner plate 142 is drawn outward toward the outer plate 146 to claim the bracket assembly 140 tightly in the slot 110.

The upper pair of slots 174 accommodates a pulley support arm bolt 178 that extends through the slots 174 and through the leg 134 into a threaded support post 180. A pulley eyebolt 218 threads into the opposite end of the threaded support post 180. The eyebolt 218 is in turn fastened to a pulley 216 as shown in FIGS. 1–5. By loosening the bolt 178, the pulley 216 may be adjusted up and down within the slot 174 to a position preferred by a user of the apparatus in accordance with the invention.

Other configurations of clamping members are also envisioned by the present invention. The structure of the particular embodiments 140 and 240 described above is simply one way of fastening the lower ends of the legs 134 to the T shaped slots in the rails of a reformer exercise apparatus 100. For example, a cam locking structure with a set of counteracting cams to engage the sides of the slots 110 may be utilized and may be applied in the slots 110 to securely fasten the legs 134 to the frame 102. Another example would be a set of sliding wedge members that slide to expand against the walls of the slot 110.

Accordingly, the invention may be practiced other than as specifically described and shown herein with reference to the illustrated embodiments. The present invention is not intended to be limited to the particular embodiments illustrated but is intended to cover all such alternatives, modifications, and equivalents as may be included by the following claims. All patents, patent applications, and printed publications referred to herein are hereby incorporated by reference in their entirety.

What is claimed is:

1. An exercise apparatus comprising:

a generally rectangular frame having a pair of end members and a pair of spaced apart parallel side rail members forming part of said frame, wherein each said rail member has an outwardly open T shaped slot;

a moveable carriage mounted on said frame for movement along said rail members between said end members, said carriage having a generally flat upper surface, a pair of spaced shoulder stops mounted to said upper surface of said carriage and a plurality of support/guide wheel assemblies mounted to an underside of said carriage; and a generally U shaped trapeze assembly removably fastened in said T shaped slots.

2. The exercise apparatus of claim 1 wherein said trapeze assembly comprises an arched frame portion joining two parallel frame legs and an adjustable leg support bracket assembly fastened to each of the frame legs, each said bracket assembly clamping the trapeze frame leg to the reformer frame via the T shaped slot.

3. The exercise apparatus of claim 2 wherein a free end of each trapeze frame leg has a longitudinal open slot therein and a first closed longitudinal slot spaced from the open slot.

4. The exercise apparatus according to claim 1 wherein said trapeze assembly is foldable between an upright operating position and a storage position generally parallel to said rail members of said rectangular frame.

5. The exercise apparatus of claim 4 wherein said trapeze assembly comprises an arched frame portion joining two parallel frame legs and an adjustable leg support bracket assembly fastened to each of the frame legs, each said bracket assembly clamping the trapeze frame leg to the reformer frame via the T shaped slot.

6. The exercise apparatus of claim 5 wherein a free end of each trapeze frame leg has a longitudinal open slot therein and a first closed longitudinal slot spaced from the open slot.

7. The exercise apparatus of claim 5 wherein said adjustable leg support bracket assembly comprises:

an elongated inner plate having a cross sectional outer shape complementary to the T shaped slot so as to slide within the slot;

a rectangular spacer tube fastened to an outer face of the inner plate adjacent to a clamp portion of the inner plate; and an outer bracket plate fastened to the spacer plate, the bracket plate having a pair of spaced upper and lower holes therethrough each for receiving a clamp bolt therethrough.

8. The exercise apparatus of claim 7 wherein a free end of each trapeze frame leg has a longitudinal open slot therein and a first closed longitudinal slot spaced from the open slot.

9. The exercise apparatus of claim 8 wherein each clamp bolt passes through one of the trapeze frame legs through one of the slots in the one trapeze frame leg.

10. The exercise apparatus of claim 9 wherein a lower one of the clamp bolts passes through the outer plate, the open slot, and into the clamp portion of the inner plate.

11. An exercise apparatus comprising:

a generally rectangular frame having a head end, a foot end and a pair of spaced apart parallel rail members therebetween, each of said rail members including an outwardly open T shaped longitudinal slot therein;

a movable carriage mounted on said frame for movement along said rail members between said head and foot ends, said carriage having a generally flat upper surface, a pair of spaced shoulder stops mounted to said upper surface and a head rest extending toward said head end from said upper surface of said carriage;

a plurality of elongated elastic members extending between said carriage and said foot end of said frame;

a foot support assembly mounted to said frame near said foot end comprising a U shaped foot bar having a pair of spaced parallel leg portions each forming a support member, each support member being fastened to a foot bar support bracket assembly, each said foot bracket assembly having an elongated anchor bar member slidably disposed in one of said slots in said rail members; and a generally U shaped trapeze assembly removably fastened in said T shaped slots near said head end of said frame.

12. The exercise apparatus of claim 11 wherein said trapeze assembly comprises an arched frame portion joining two parallel frame legs and an adjustable leg support bracket assembly fastened to each of the frame legs, each said bracket assembly clamping the trapeze frame leg to the reformer frame via the T shaped slot.

13. The exercise apparatus of claim 12 wherein a free end of each trapeze frame leg has a longitudinal open slot therein and a first closed longitudinal slot spaced from the open slot.

14. The exercise apparatus according to claim 11 wherein said trapeze assembly is foldable between an upright operating position and a storage position generally parallel to said rail members of said rectangular frame.

15. The exercise apparatus of claim 14 wherein said trapeze assembly comprises an arched frame portion joining two parallel frame legs and an adjustable leg support bracket assembly fastened to each of the frame legs, each said bracket assembly clamping the trapeze frame leg to the reformer frame via the T shaped slot.

16. The exercise apparatus of claim 15 wherein a free end of each trapeze frame leg has a longitudinal open slot therein and a first closed longitudinal slot spaced from the open slot.

17. The exercise apparatus of claim 15 wherein said adjustable leg support bracket assembly comprises:

an elongated inner plate having a cross sectional outer shape complementary to the T shaped slot so as to slide within the slot;

a rectangular spacer tube fastened to an outer face of the inner plate adjacent to a clamp portion of the inner plate; and an outer bracket plate fastened to the spacer plate, the bracket plate having a pair of spaced upper and lower holes therethrough each for receiving a clamp bolt therethrough.

18. A generally U shaped trapeze assembly for mounting to a reformer exercise apparatus having parallel frame rails and each rail having an outwardly open T shaped slots in the rail, the trapeze assembly comprising:

an arched frame portion joining two parallel trapeze frame legs; and means riding in the slots for adjustably clamping each of the trapeze frame legs to the frame rail via its slot.

19. The assembly according to claim 18 wherein the clamping means is an adjustable leg support bracket assembly fastened to each of the trapeze frame legs, each said bracket assembly clamping the trapeze frame leg to the reformer frame via the T shaped slot.

20. The assembly according to claim 19 wherein bracket assembly comprises:

an elongated inner plate having a cross sectional outer shape complementary to the T shaped slot so as to slide within the slot;

a rectangular spacer tube fastened to an outer face of the inner plate adjacent to a clamp portion of the inner plate;

an outer bracket plate fastened to the spacer plate, the bracket plate having a pair of spaced upper and lower holes therethrough; and a pair of clamp bolts in the holes to fasten the frame leg to the outer bracket plate.

* * * * *